US009166287B2

(12) United States Patent
Lin

(10) Patent No.: US 9,166,287 B2
(45) Date of Patent: Oct. 20, 2015

(54) ANTENNA SHEATH

(71) Applicant: GRAND-TEK TECHNOLOGY CO., LTD., New Taipei (TW)

(72) Inventor: Yu-Wei Lin, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 173 days.

(21) Appl. No.: 14/145,639

(22) Filed: Dec. 31, 2013

(65) Prior Publication Data

US 2014/0210688 A1 Jul. 31, 2014

(30) Foreign Application Priority Data

Jan. 29, 2013 (TW) ..... 102201914 U

(51) Int. Cl.
*H01Q 1/42* (2006.01)
*H01Q 3/04* (2006.01)
*H01Q 1/08* (2006.01)

(52) U.S. Cl.
CPC ..... *H01Q 3/04* (2013.01); *H01Q 1/084* (2013.01); *H01Q 1/42* (2013.01); *H01Q 1/428* (2013.01)

(58) Field of Classification Search
CPC ..... H01Q 1/428; H01Q 1/42
USPC ..... 343/872
See application file for complete search history.

(56) References Cited

U.S. PATENT DOCUMENTS

| | | | | |
|---|---|---|---|---|
| 6,963,311 | B1 * | 11/2005 | Enns | 343/702 |
| 7,046,212 | B2 * | 5/2006 | Tai et al. | 343/882 |
| 8,368,603 | B2 * | 2/2013 | Huang | 343/702 |
| 2009/0322645 | A1 * | 12/2009 | Sun | 343/872 |

* cited by examiner

*Primary Examiner* — Hoang V Nguyen
(74) *Attorney, Agent, or Firm* — Chun-Ming Shih; HDLS IPR SERVICES

(57) ABSTRACT

An antenna sheath includes a tubular member and a base unit. One end of the tubular member is formed with two lateral boards corresponding to each other, an opening is formed between the two lateral boards, each of the lateral boards is formed with a shaft hole, and the inner periphery of at least one of the two shaft holes is formed with at least one first convex tooth; the base unit is installed with a connector inserted in the opening and formed with two lateral surfaces corresponding to each other, the two lateral surfaces are respectively installed with a rotation shaft correspondingly pivoted in the shaft hole, the outer periphery of at least one of the two rotation shafts is formed with plural second convex teeth annularly arranged, and the first convex teeth is engaged between any two of the adjacent second convex teeth.

9 Claims, 7 Drawing Sheets

ANTENNA SHEATH

BACKGROUND OF THE INVENTION

1. Field of the Invention

The present invention relates to an antenna sheath, especially to an antenna sheath capable of being processed with an angle adjustment.

2. Description of Related Art

An antenna is mainly used for transmitting wireless signals and applied in the technical fields such as broadcasting, wireless internet or personal mobile communication. An antenna includes an antenna sheathe and an antenna body accommodated inside the antenna sheath, for the purpose of facilitating the antenna emitting and receiving wireless signals, the antenna sheath is designed to have its inclined angle being adjustable.

A conventional antenna sheath includes a tubular member, a base unit and an insertion pin. The base unit is installed with a connector which is inserted in the bottom end of the tubular member, and the insertion pin is radially inserted therebetween thereby forming a pivotal connecting status. Wherein, the angle adjustment structure is formed between the connector and an inner wall at the bottom end of the tubular member so as to achieve the effect of adjusting the angle of the antenna.

However, the existing angle adjustment device can only provide the adjustment for several large angles, a small angle adjustment is unable to be carried out, thus the mentioned device can not satisfy the actual operation needs. Moreover, the existing antenna sheath has to be additionally provided with an insertion pin inserted between the tubular member and the base unit, so the angle adjustment can be processed with the insertion pin serving as the shaft, thereby causing the assembly to be more time consuming and labor consuming and causing a problem of the insertion pin may be lost before being assembled.

As such, the applicant of the present invention has devoted himself for solving the mentioned disadvantages.

SUMMARY OF THE INVENTION

The present invention is to provide an antenna sheath, in which a tubular member is formed with a shaft hole having at least a first convex tooth, and a connector of a base unit is installed with a rotation shaft having second convex teeth, so the angle adjustment of the antenna is provided with a small angle fine tuning effect, and an insertion pin is not additionally required thereby having the advantage of saving time and labor in assembly.

The present invention is to provide an antenna sheath, in which a tubular member is additionally formed with positioning ribs and a connector is additionally formed with positioning grooves, thereby enabling the angle adjustment of the antenna to be provided with a large angle adjustment effect (0 degree, 45 degrees and any other degree between 90 to 135 degrees).

Accordingly, the present invention provides an antenna sheath, which includes: a tubular member, one end thereof is formed with two lateral boards corresponding to each other, an opening is formed between the two lateral boards, each of the lateral boards is formed with a shaft hole, the inner periphery of at least one of the two shaft holes is formed with at least one first convex tooth; and a base unit installed with a connector inserted in the opening, the connector is formed with two lateral surfaces corresponding to each other, the two lateral surfaces are respectively installed with a rotation shaft, each of the rotation shafts is correspondingly pivoted in each of the shaft holes, the outer periphery of at least one of the two rotation shafts is formed with plural second convex teeth which are annularly arranged, the first convex teeth is engaged between any two of the adjacent second convex teeth.

Wherein, inner walls of the two lateral boards are respectively formed with a positioning rib corresponding to each other, the two lateral surfaces of the connector are respectively formed with plural positioning grooves corresponding to each other, the positioning rib of each of the lateral boards is selectively and correspondingly engaged in any of the positioning grooves of each of the lateral surfaces so as to be positioned.

In comparison with related art, the present invention has advantageous features as follows: an insertion pin is not required additionally, thereby achieving the effects of saving time and labor in assembly and an concern of losing the insertion pin is avoided; moreover, not only the large angle adjustment is provided, the small angle adjustment is also be provided.

DETAILED DESCRIPTION OF THE INVENTION

Preferred embodiments of the present invention will be described with reference to the drawings.

Figure 4:
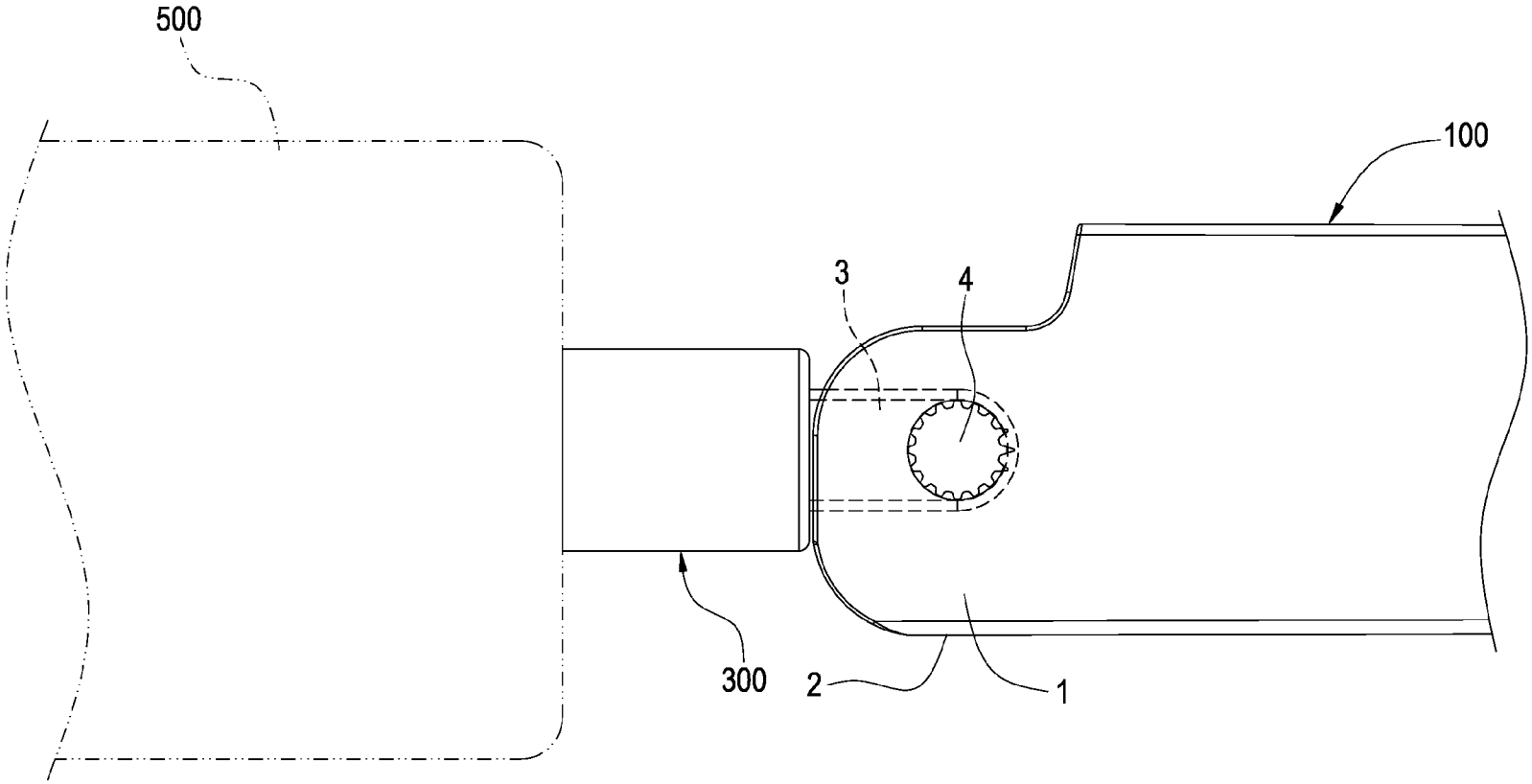
FIG. 4 is a side view illustrating the antenna sheath being connected to an electronic device before an angle adjustment being processed according to the present invention.

Please refer to FIG. 4, the present invention provides an antenna sheath, which is used in an electronic device 500 thereby allowing an antenna body (not shown in figures) of the electronic device 500 to be accommodated inside the antenna sheath for emitting or receiving wireless signals.

Figure 1:
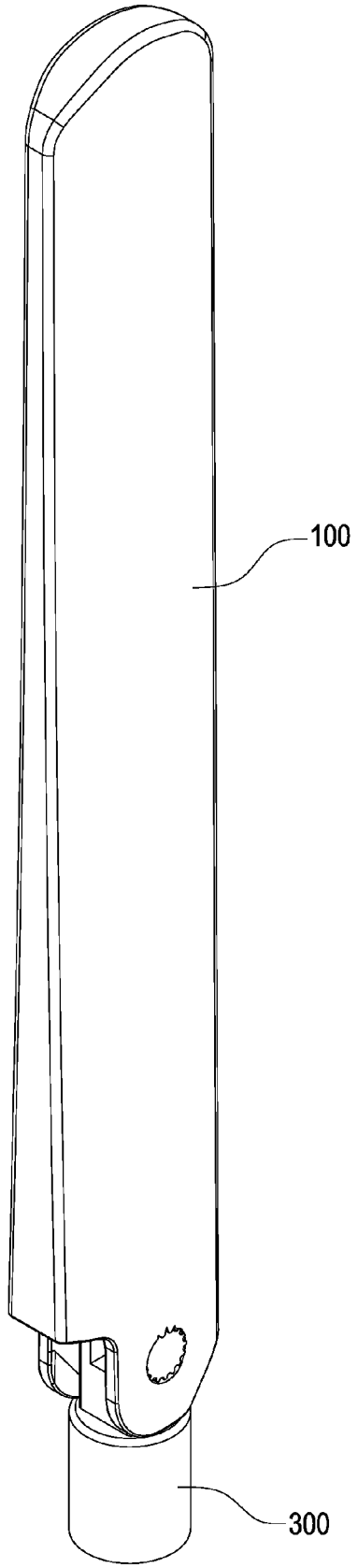
FIG. 1 is a perspective view showing the appearance of the antenna sheath according to the present invention.
Figure 2:
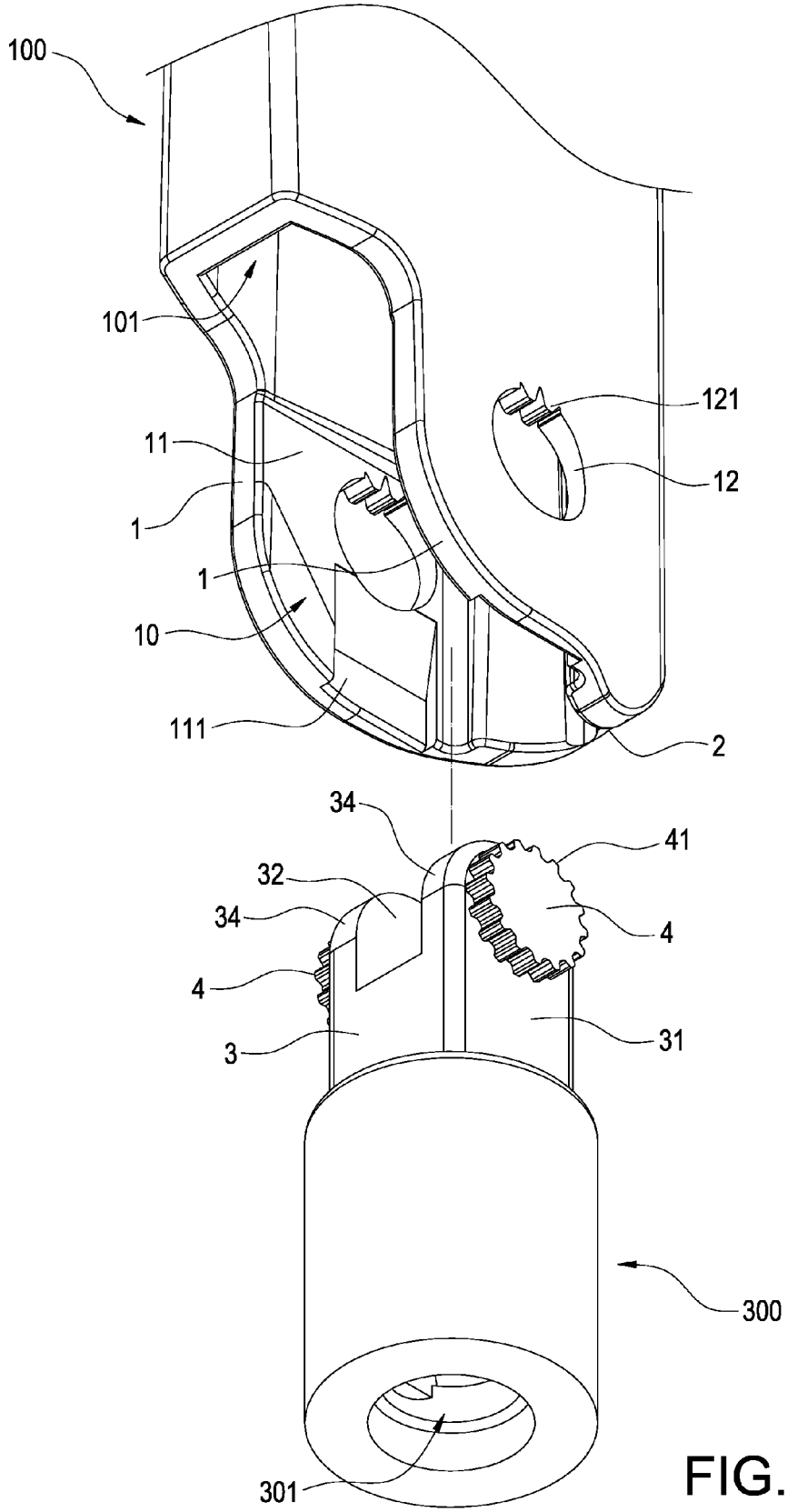
FIG. 2 is a partially enlarged perspective exploded view showing the antenna sheath according to the present invention.
Figure 3:
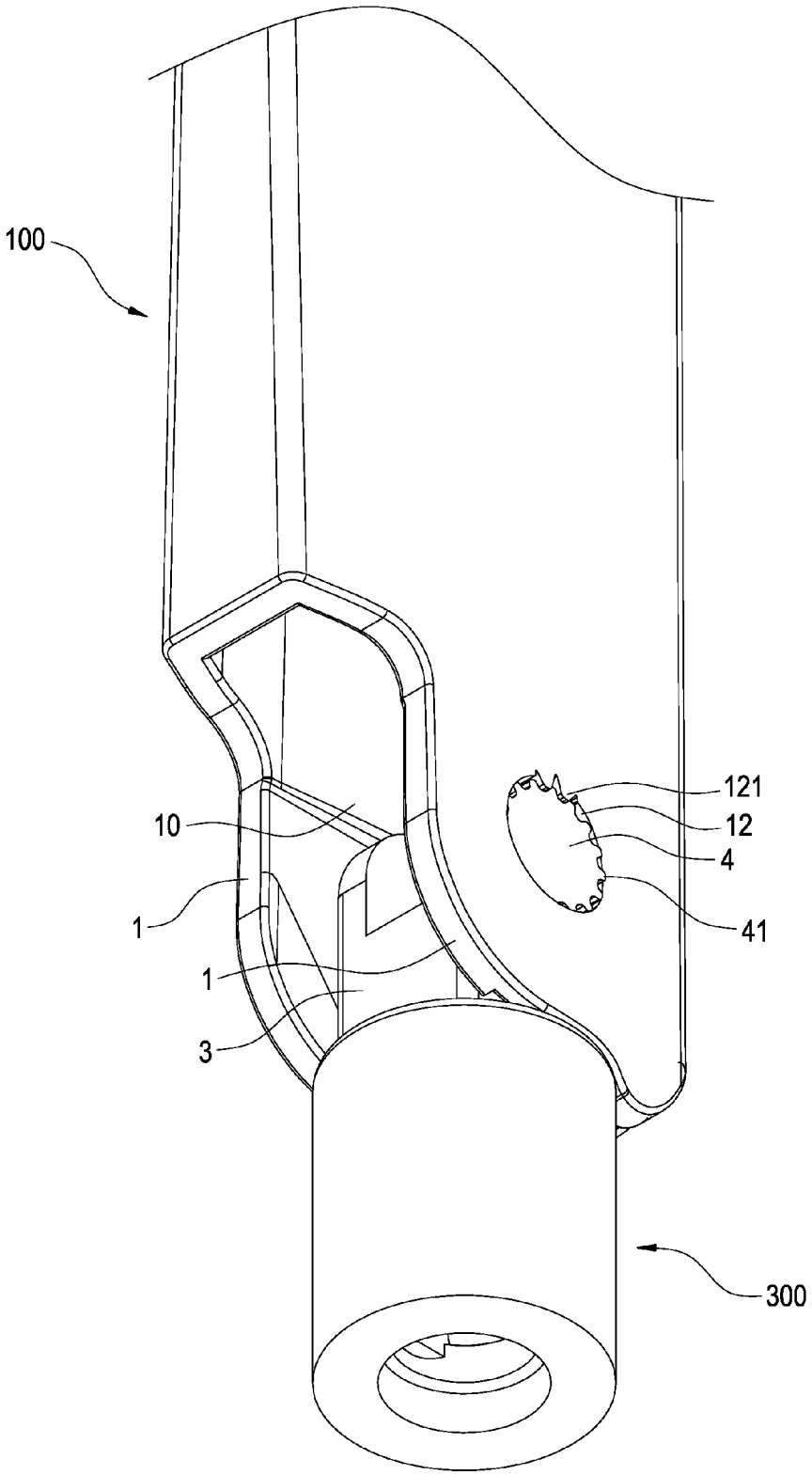
FIG. 3 is a partially enlarged perspective view showing the assembly of the antenna sheath according to the present invention.

Please refer from FIG. 1 to FIG. 3, Wherein FIG. 1 is a perspective view showing the appearance of the antenna sheath according to the present invention; FIG. 2 is a partially enlarged perspective exploded view showing the antenna sheath according to the present invention; and FIG. 3 is a partially enlarged perspective view showing the assembly of the antenna sheath according to the present invention. According to the present invention, the antenna sheath includes a tubular member 100 and a base unit 300.

The tubular member 100 is formed as a hollow tube, and formed with a first chamber 101 for accommodating the antenna body (not shown in figures). The bottom end of the tubular member 100 is formed with two lateral boards 1 corresponding to each other, an opening 10 is formed between the two lateral boards 1, according to this embodiment, the opening 10 is defined by the two lateral boards 1 and a connection board 2, wherein the connection board 2 is connected to the same sides of the two lateral boards 1. Each of the lateral boards 1 is formed with a shaft hole 12, the inner periphery of at least one of the two shaft holes 12 is radially formed with at least a first convex tooth 121, according to this embodiment, the inner periphery of each of the shaft holes 12 is radially formed with two first convex teeth 121.

The base unit 300 is formed in hollow and formed with a second chamber 301 allowing the antenna body (not shown in figures) to pass. The base unit 300 is upwardly and protrudingly installed with a connector 3 thereby enabling to be inserted in the opening 10 of the tubular member 100 through the connector 3. The connector 3 is formed with two lateral surfaces 31 corresponding to each other, the two lateral surfaces 31 are respectively installed with a rotation shaft 4, when the connector 3 is inserted in the opening 10, each of the rotation shafts 4 is correspondingly pivoted in each of the shaft holes 12. The outer periphery of at least one of the two rotation shafts 4 is formed with plural second convex teeth 41 which are annularly arranged, according to this embodiment, the outer periphery of each of the rotation shafts 4 is formed with the plural second convex teeth 41 which are annularly arranged, and any of the first convex teeth 121 is engaged between any two of the adjacent second convex teeth 41.

Figure 5:
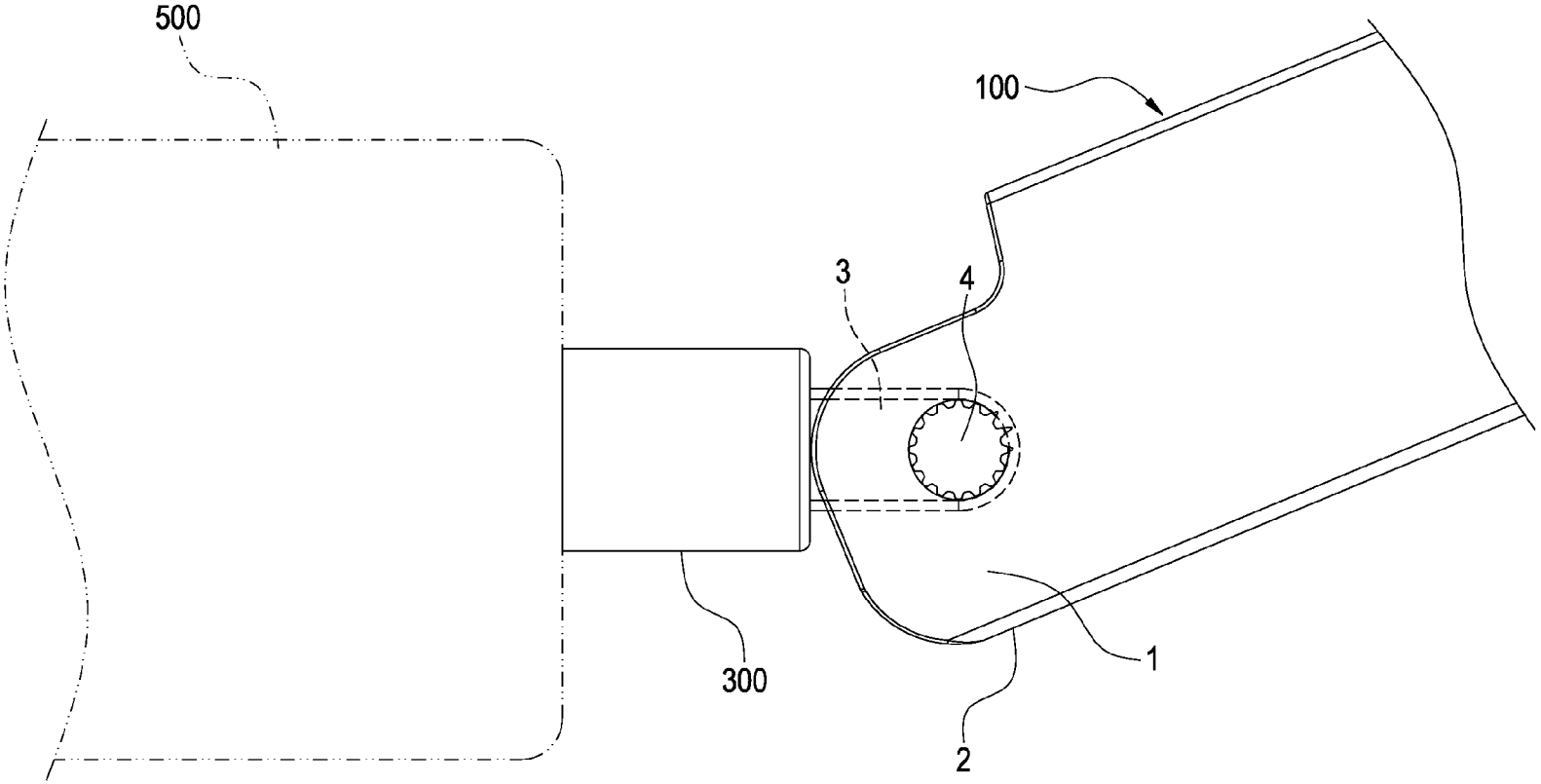
FIG. 5 is a side view showing the FIG. 4 after the angle adjustment being processed.
Figure 6:
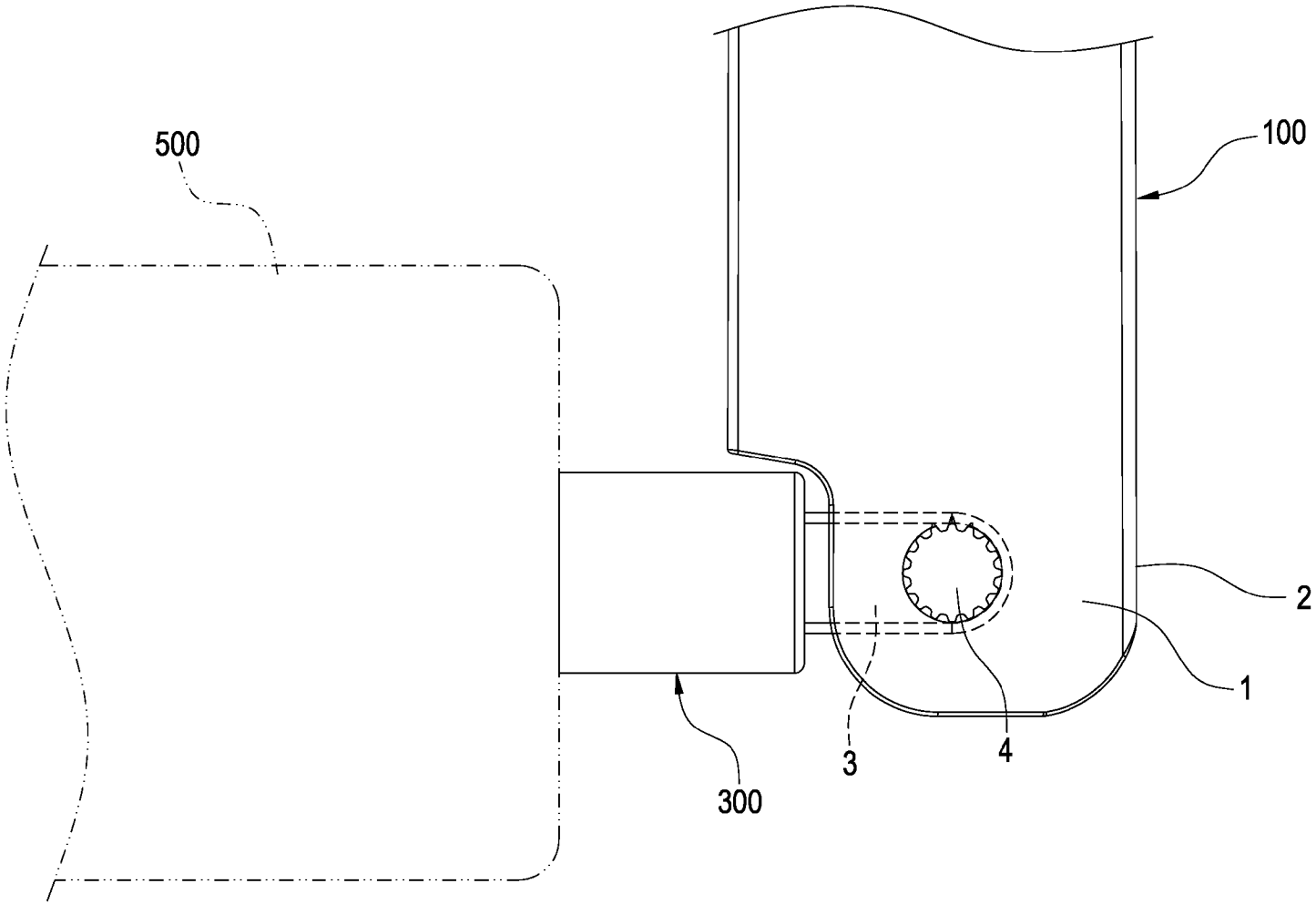
FIG. 6 is a side view showing the FIG: 5 after another angle adjustment being processed.

Please refer from FIG. 4 to FIG. 6, wherein FIG. 4 is a side view illustrating the antenna sheath being connected to an electronic device before an angle adjustment being processed according to the present invention; FIG. 5 is a side view showing the FIG. 4 after the angle adjustment being processed; and FIG. 6 is a side view showing the FIG. 5 after another angle adjustment being processed. The electronic device 500 can be any electronic device in which emitting or receiving wireless signals being required, the present invention is limited to be applied in certain type of electronic device.

According to this embodiment, through pulling the tubular member 100, the tubular member 100 is enabled to rotate with the rotation shafts 4 and the shaft holes 12 serving as the shaft, during the rotation, any of the first convex teeth 121 is elastically moved between the second convex teeth 41, and a positioning effect is formed as long as the first convex tooth 121 is engaged between any two of the adjacent second convex teeth 41, in other words the antenna sheath provided by the present invention allows a small angle adjustment to be processed, so not only three large angle adjustments (0 degree, 45 degrees and 90 degrees) can be processed.

Please refer from FIG. 1 to FIG. 3, the top end (i.e. the end facing the opening 10) of the connector 3 is formed with at least a notch 32, according to this embodiment, only one notch 32 is provided for the purpose of illustration, the top end of the connector 3 is formed with two lugs 34 corresponding to each other, and the notch 32 is located between the two rotation shafts 4, so when the connector 3 is inserted in the opening 10, the two lugs 34 can be forced to be close to each other through being pressed by two inner walls 11, thereby allowing the connector 3 to be more smoothly inserted in the opening 10. Preferably, the inner walls 11 of the two lateral boards 1 are respectively formed with a recess part 111, each of the recess parts 111 is connected to each of the shaft holes 12, so each of the rotation shafts 4 is able to be correspondingly pivoted in each of the shaft holes 12 through passing each of the recess parts 111, thereby allowing the connector 3 to be more smoothly inserted in the opening 10. As shown in figures, the recess part 11 is formed as gradually recessed in the inner wall 11, the top end (i.e. the end of the recess part 111 connected to the shaft hole 12) is gradually recessed towards the bottom end (i.e. the other end of the recess part 111 away from the shaft hole 12), and the bottom end of the recess part 111 is opened, thereby allowing the rotation shaft 4 to smoothly pass during the insertion.

When the base unit 300 is connected to the tubular member 100 through the connector 3, the second chamber 301 penetrating the connector 3 is in communication with the first chamber 10 communicating with the opening 10, thereby allowing the antenna body' (not shown in figures) to be accommodated.

Figure 7:
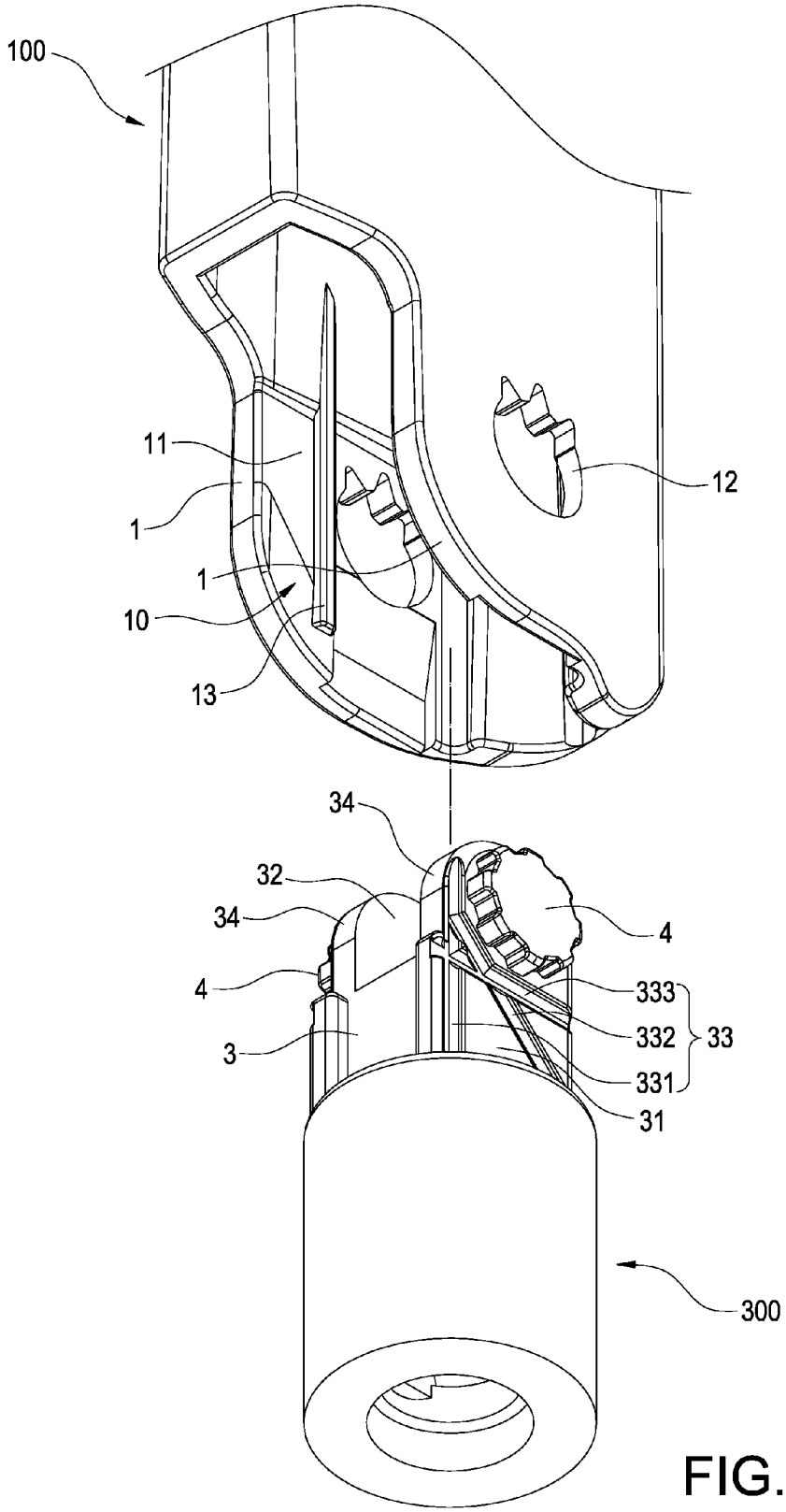
FIG. 7 is a partially enlarged perspective exploded view showing the antenna sheath according to another embodiment of the present invention.

Please refer to FIG. 7, which is a partially enlarged perspective exploded view showing the antenna sheath according to another embodiment of the present invention. This another embodiment is substantially the same as the previous embodiment, the difference is that positioning ribs 13 and positioning grooves 33 are provided.

As shown in FIG. 7, the inner walls 11 of the two lateral boards 1 are respectively formed with a positioning rib 13 corresponding to each other, the two lateral surfaces 31 of the connector 3 are respectively formed with plural positioning grooves 33 corresponding to each other, the positioning rib 13 of each of the lateral boards 1 is able to be selectively and correspondingly engaged in any of the positioning grooves 33 of each of the lateral surfaces 31 so as to be positioned. According to this another embodiment, the positioning grooves 33 include a first positioning groove 331, a second positioning groove 332 and a third positioning groove 333. The first positioning groove 331 is formed towards the opening 10 (e.g. oriented in 0 degree), the third positioning groove 333 is formed crossing to the first positioning groove 331 (e.g. oriented in 90 degrees, or larger than 90 degrees which is not shown in figures), the second positioning groove 332 is formed between the first positioning groove 331 and the third positioning groove 333 (e.g. oriented in 45 degrees), the positioning ribs 13 are formed towards the same direction as the first positioning groove 331. Accordingly, with the another embodiment provided by the present invention, an large angle adjustment can be processed through the positioning ribs 13 and the positioning grooves 33 for providing the angle adjustment of 0 degree, 45 degrees and 90 degrees (or any other degree between 90 to 135 degrees), and the small angle adjustment can be processed through the first and the second convex teeth 121, 41.

As what has been disclosed above, the present invention is provided with following advantages while being compared with related art: according to the two embodiments, an insertion pin is not required additionally, thereby achieving the effects of saving time and labor in assembly and an concern of losing the insertion pin is avoided; moreover, according to the two embodiments provided by the present invention, the former embodiment discloses the effect of processing the small angle adjustment, and the later embodiment discloses the effect of processing the large angle adjustment of 0 degree, 45 degrees and 90 degrees (or any other degree between 90 to 135 degrees) while the small angle adjustment is also provided, and a slight feeling of angle adjustment can be provided by adopting the first and the second convex teeth 121, 41, a stronger feeling of angle adjustment (which can be felt at 0 degree, 45 degrees and 90 degrees) can be provided by adopting the positioning ribs 13 and the positioning grooves 33.

Although the present invention has been described with reference to the foregoing preferred embodiment, it will be understood that the invention is not limited to the details thereof Various equivalent variations and modifications can still occur to those skilled in this art in view of the teachings of the present invention. Thus, all such variations and equivalent modifications are also embraced within the scope of the invention as defined in the appended claims.

What is claimed is:

1. An antenna sheath, including:

a tubular member, one end thereof is formed with two lateral boards corresponding to each other, wherein an opening is formed between the two lateral hoards, each of the lateral hoards is formed with a shaft hole, and the inner periphery of at least one of the two shaft holes is formed with at least one first convex tooth; and a base unit installed with a connector inserted in the opening, wherein the connector is formed with two lateral surfaces corresponding to each other, the two lateral surfaces are respectively installed with a rotation shaft, each of the rotation shafts is correspondingly pivoted in each of the shaft holes, the outer periphery of at least one of the two rotation shafts is formed with plural second convex teeth which are annularly arranged, and the first convex teeth is engaged between any two of the adjacent second convex teeth.

2. The antenna sheath according to claim 1, wherein the end of the connector facing the opening is formed with at least a notch, and the notch is located between the two rotation shafts.

3. The antenna sheath according to claim 1, wherein the opening is defined by the two lateral boards and a connection board, and the connection board of the tubular member is connected to the same sides of the two lateral boards.

4. The antenna sheath according to claim 1, wherein inner walls of the two lateral boards are respectively formed with a recess part, and each of the recess parts is connected to each of the shaft holes, so each of the rotation shafts is able to be correspondingly pivoted in each of the shaft holes through passing each of the recess parts.

5. The antenna sheath according to claim 4, wherein the recess part of each of the lateral boards is gradually recessed towards the inner wall, the end of the recess part connected to the shaft hole is gradually recessed towards the other end of the recess part away from the shaft hole, and the other end of the recess part is opened.

6. The antenna sheath according to claim 1, wherein the tubular member is formed with a first chamber communicating with the opening, the base unit is formed with a second chamber penetrating the connector, and the first chamber is in communication with the second chamber.

7. The antenna sheath according to claim 1, wherein each of the first convex teeth is radially protruded from the inner periphery of the shaft hole.

8. The antenna sheath according to claim 1, wherein the inner walls of the two lateral boards are respectively formed with a positioning rib corresponding to each other, the two lateral surfaces of the connector are respectively formed with plural positioning grooves corresponding to each other, and the positioning rib of each of the lateral boards is able to be selectively and correspondingly engaged in any of the positioning grooves of each of the lateral surfaces so as to be positioned.

9. The antenna sheath according to claim 8, wherein the positioning grooves include a first positioning groove, a second positioning groove and a third positioning groove, the first positioning groove of each of the lateral surfaces is formed towards the opening, the third positioning groove of each of the lateral surfaces is formed crossing to the first positioning groove, the second positioning groove of each of the lateral surfaces is formed between the first positioning groove and the third positioning groove, and the positioning rib of each of the lateral boards is formed towards the same direction as the first positioning groove.

* * * * *